US006119438A

United States Patent [19]

Bacon et al.

[11] Patent Number: 6,119,438

[45] Date of Patent: Sep. 19, 2000

[54] TRANSITIONAL PRODUCT FLOW AND ADAPTIVE CONTROL

[75] Inventors: Forrest C. Bacon, Conyers; Gary G. Highberger, Atlanta, both of Ga.

[73] Assignee: Kliklok Corporation, Decatur, Ga.

[21] Appl. No.: 08/983,550

[22] PCT Filed: Jun. 26, 1996

[86] PCT No.: PCT/US96/10946

§ 371 Date: Dec. 23, 1997

§ 102(e) Date: Dec. 23, 1997

[87] PCT Pub. No.: WO97/02179

PCT Pub. Date: Jan. 23, 1997

Related U.S. Application Data

[60] Provisional application No. 60/000,750, Jun. 30, 1995.

[51] Int. Cl.[7] ..... B65B 9/06; B65B 1/30

[52] U.S. Cl. ..... 53/451; 53/493; 53/504; 53/552

[58] Field of Search ..... 53/451, 551, 552, 53/493, 504

[56] References Cited

U.S. PATENT DOCUMENTS

| | | | |
|---|---|---|---|
| 2,960,808 | 11/1960 | Pike . | |
| 3,040,490 | 6/1962 | Virta . | |
| 4,090,344 | 5/1978 | Kelly . | |
| 4,418,771 | 12/1983 | Henry et al. . | |
| 4,506,488 | 3/1985 | Matt et al. . | |
| 4,514,963 | 5/1985 | Bruno | 53/493 |
| 4,538,692 | 9/1985 | Henry et al. . | |
| 4,722,373 | 2/1988 | Roovers | 53/551 |
| 4,729,210 | 3/1988 | Galliano | 53/551 |
| 4,738,287 | 4/1988 | Klinkel | 53/551 |
| 4,964,258 | 10/1990 | Seko et al. . | |
| 5,147,491 | 9/1992 | Thomas et al. . | |
| 5,388,387 | 2/1995 | McElvey | 53/551 |
| 5,473,866 | 12/1995 | Maglecic | 53/552 |
| 5,524,420 | 6/1996 | Ikuta | 53/504 |
| 5,533,322 | 7/1996 | Bacon et al. . | |
| 5,540,035 | 7/1996 | Plahm et al. . | |
| 5,546,733 | 8/1996 | Paltrinieri . | |
| 5,551,206 | 9/1996 | Fukuda . | |

*Primary Examiner*—John Sipos
*Attorney, Agent, or Firm*—King and Schickli, PLLC

[57] ABSTRACT

A method and apparatus for feeding substantially free flowing solid product charges (P''') in a continuous vertical form, fill and seal packaging machine (10) is disclosed. Improved transitional product flow from the computerized weigher (W) to the bag former and closer is obtained by tracking and sampling the charges along the flow path. In the method, the steps include sensing the presence of the charges along the flow path at two locations, comparing each sensed charge presence to a defined time target that has previously been determined and adjusting at least one operating step in accordance with any deviation found to cause the charge or charges to approach the defined time target for optimum operation. Either a predictive time adaptive control (77) requiring operator input, or computer control (76) can be incorporated into the method. A series of product charge flow enhancers (102, 103; 131; 121) are provided along the flow path to assist in maintaining the charges within the time target.

22 Claims, 5 Drawing Sheets

GAS FLUSH ENTRANCE
PRODUCT FLOW
103
120b
AIR SOURCE
120
107
120a

PRODUCT FLOW
103
120
F
F
107
F
C1
F
51, 52
132
130
C1
C2
F 132
136
135
137
107

132
107
C2
C1

$r = r+1 = r+2$

TRANSITIONAL PRODUCT FLOW AND ADAPTIVE CONTROL

This application claims the benefit of U.S. Provisional application No. 60/000,750, filed Jun. 30, 1995.

TECHNICAL FIELD

The present invention relates to packaging methods/machines for substantially free flowing product charges, and more particularly to a continuous vertical form, fill and seal packaging machine and product charge feeding method/apparatus with improved transitional product flow and having integrated computer control that includes tracking and sampling of the flow of the product charges along the feed path to the bag with adaptive feed back.

BACKGROUND OF THE INVENTION

In recent years, there has been substantial advancements made in speeding up the process of forming packages, such as pillow-type packages on a form, fill and seal packaging machine. The advancement is primarily in computerized combination weighing wherein addition to speeding up the overall packaging process. A leading approach in computerized weighing is set forth in the circuit described and claimed in U.S. Pat. Nos. 4,418,771 entitled "Method and Apparatus for Combination Weighing" and 4,538,692, entitled "Method and Apparatus for Combination Weighing With Multiple Storage Cups for Each Scale Hopper" owned by the present assignee.

Furthermore, substantial progress has been made in controlling the apparatus for actually forming the bag with advanced computer control. In the latest advancement, a computer control system is provided wherein a central processing unit (CPU), such as an IBM Compatible Computer with an Intel 486 microprocessor, including at least a 4-axis coordinator operates the package forming apparatus in a very efficient manner. Specifically, the combination weigher, the film feeder/seamer, the vibrating clamp for settling the product, and the moving carriage/stripper/sealing jaws are all synchronized so that maximum operating speeds in excess of 140 bags/minute, and even approaching 200 bags/minute, are attainable. This advanced system is described and claimed in copending applications assigned to the present application, including U.S. patent application Ser. No. 08/350,877 entitled "Continuous Vertical Form, Fill and Seal Packaging Machine With Synchronized Product Clamp", filed Dec. 7, 1994 now U.S. Pat. No. 5,040,035.

In terms of increased speed and overall operational accuracy, the advancement in the '877 application is proven to be very successful. The timing and interaction of the various components of the package forming apparatus and weigher is such so as to allow several product charges to be in transition from the weigher to the package forming apparatus at one time. This action is effective to eliminate dead time where one component waits on another, to thereby allow increased speed of operation. The various components for feeding/vertically seaming the film, clamping the film and settling the product and forming the transverse seal carry out the process in an optimum manner. No longer is the packaging machine set up in such a manner as to match the worst case scenario of these various components. For a complete and full description and understanding of this area of the overall packaging system, reference should be made to the '877 application.

Thus, the packaging machinery industry, and particularly with regard to form, fill and seal packaging machines, finds itself in a situation where computerized combination weighing is at a very advanced level to provide highly accurate weighing at greatly increased speeds, and the actual package forming apparatus and method has likewise reached a very advanced state. However, little or no control is provided in the area of transitional product flow between the weigher and the packaging forming apparatus. In other words, once the product charge from the combination weigher is formed until it reaches the package forming station, that is where the package is filled, formed and sealed, little or no advancement has been made. Essentially, the industry is still relying on the worst case scenario that occurs in the transitional product flow path along which the product charge must travel between the combination weigher and the package forming station. This results in the packaging machinery operator having to slow the system to accept the slowest product charge and the longest charge stringout (vertical spread), when in fact the machine/process is optimized in the other two areas (combination weighing/package forming). We have recognized that this transitional area of the packaging machine has become the proverbial bottle neck of the machine/system and we believe the time has come for its elimination.

Thus, an important aspect of the present invention is that the transitional flow path of a free flowing product, such as potato chips or other snack foods, is now recognized by us as being very important to the overall maximizing of the speed and efficiency of the packaging system.

SUMMARY OF THE INVENTION

Accordingly, it is a primary object of the present invention to provide a method and apparatus for overcoming the difficulties of the prior art in the area of substantially free flowing product flow relating to packaging methods and machines.

It is another object of the present invention to provide a method for improving transitional product flow to bring about overall increased speed and efficiency of packaging methods/machines.

It is still another object of the present invention to provide improved methods and apparatus for feeding sequential product charges and through adaptive control increasing the speed and efficiency of the translational product flow along the defined flow path.

Still another object of the present invention is to provide an improved method for feeding product charges wherein the charge is sensed as it moves along a flow path, comparing the charge presence to a calculated and defined time target or standard, and adjusting one or more operating steps to cause the next in line charge to approach the defined time target.

It is a related object of the present invention to provide an apparatus for defined free flowing product flow with improvements for increasing the speed and efficiency, as well as the predictability of the product flow along the path.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, there is provided an improved transitional product flow along a defined flow path in a packaging machine or the like, and with adaptive control to assure the maximum speed and efficiency of the product flow, and thus the overall feeding and packaging method. In particular, the method is concerned with feeding sequential product charges in packaging cycles within a defined time target. In this regard, the first step is to provide a substantially free flowing charge of product being packaged. The charge is then introduced and fed along the flow path. The presence of each charge is sensed at a selected location along the path. The presence of each charge at a first time point at the selected location is compared to the calculated time target or standard for that particular packaging method and/or machine. Finally, at least one operation step of the method/machine is adjusted in accordance with any deviation found during the comparison, or an average of deviations found over several cycles, with the overall preferred object being to bring at least one of the next in line product charges as close to the time target as possible. As a result, this adaptive control of the feeding of the product charges allows the speed and efficiency of the feeding method and/or apparatus to be maximized.

In carrying out the step of sensing the product charge, the first and second time points, that is the leading and trailing portions of each charge, are noted. During the adjusting step, a change is made in the introduction and/or feed, preferrably one of the next in line charges, so as to change the gap or relative position along the flow path. In this manner, the movement of the product charges can substantially match the time target of the packaging machine or other operating system.

In accordance with another aspect of the present invention, the sensing step is performed at at least two locations along the flow path in the packaging method/machine. In the preferred embodiment, the locations are selected as being adjacent the transition tube of the flow path and along the fill tube above the settling clamp, as will be seen more in detail below.

Because of the increased efficiency of the method/apparatus of the present invention, more than one product charge can be in flight at any one time along the feeding path. The first time point for each charge and the comparison to find the gap between these time points can be carried out at one or both of the locations along the path. Thus, it is advantageous to be able to provide more than one product charge along the defined flow path at any one time for more accurate readings and averaging. This is easily accomplished and makes the sensing operation more reliable.

Also, when the first and second time points are sensed for each charge, then the comparing step can be simplified by finding the gap between the second time point and the first time point of the next in line charge. Under all conditions of the method and apparatus, when the gap widens, the product charge introduction and feeding of one or more of the following charges is simply advanced. This is done by simply increasing the speed of the packaging machine, which of course includes the release of product from one of the storage cups or holding bins of the computerized weigher. On the other hand, if the gap narrows, then the speed of the packaging machine must be retarded in order to maintain the proper gap to insure proper machine operation.

In addition to identifying the gap between the last portion of the product in the previous charge and the first portion of the product in the second in line charge, the present method/apparatus contemplates adjusting the movement of at least one of the next in line charges in accordance with the time lag between the first and second points of any particular charge. This time lag provides a signal input as to the product stringout/vertical spread and also must be kept under control. If the stringout increases, the gap narrows and corrective action must be taken to reduce the speed of the packaging method/machine. As the time lag is reduced the speed can then be increased. Certain components of the apparatus aspect of the present invention, such as a rapidly acting product poker and an air blast positioned preferably at the mouth of the fill tube compacts and accelerates the charge to reduce the lag, and to furthermore maintain the proper gap between the in line charges.

Further with regard to the apparatus aspects of the present invention, the flow path is designed for enhanced product flow and is defined by an in line collection collar, transition tube and fill tube. The collar is annular in shape and has a sloping wall between 30°–35° with respect to the vertical axis; the transition tube wall slopes at approximately between 10°–15° and the fill tube comprises a substantially vertical annular wall. The collar and the tubes are preferably formed of sheet metal with the spacing at the merge points being approximately one sheet thickness, or approximately 0.0625 inch.

The adaptive control to provide the improved transitional product flow can be operated manually so as to provide predictive time operation or by computer to provide automatic operation. In the predictive time adaptive mode, the defined time target for introducing/feeding each individual in line charge is set by repeating the operating steps until the adjusting step is satisfied. In the computer modes of operation, as will be described more in detail below, all of the packaging steps, including forming, filling and sealing sequential packages to form bags of packaging film containing the charges, the computer automatically synchronizes and provides optimum matching of the feeding of the product charges. In any one of the operating modes, the defined time target or standard used in comparing the sensed charge presence is determined by inputting to the computer several parameters, including the packaging operation target speed, bag length being formed, the size of the former or bag girth, any appropriate blousing factor, the stripping length desired and ambient operating temperature.

Still other objects of the present invention will become apparent to those skilled in this art from the following description wherein there is shown and described the preferred embodiments of this invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrates several aspects of the present invention, and together with the description serves to explain the principles of the invention. In the drawings.

Reference will now be made in detail to the present preferred embodiments of the invention, an example of which is illustrated in the accompanying drawings.

DETAILED DESCRIPTION OF THE PREFERRED EMBODIMENT

Figure 1:
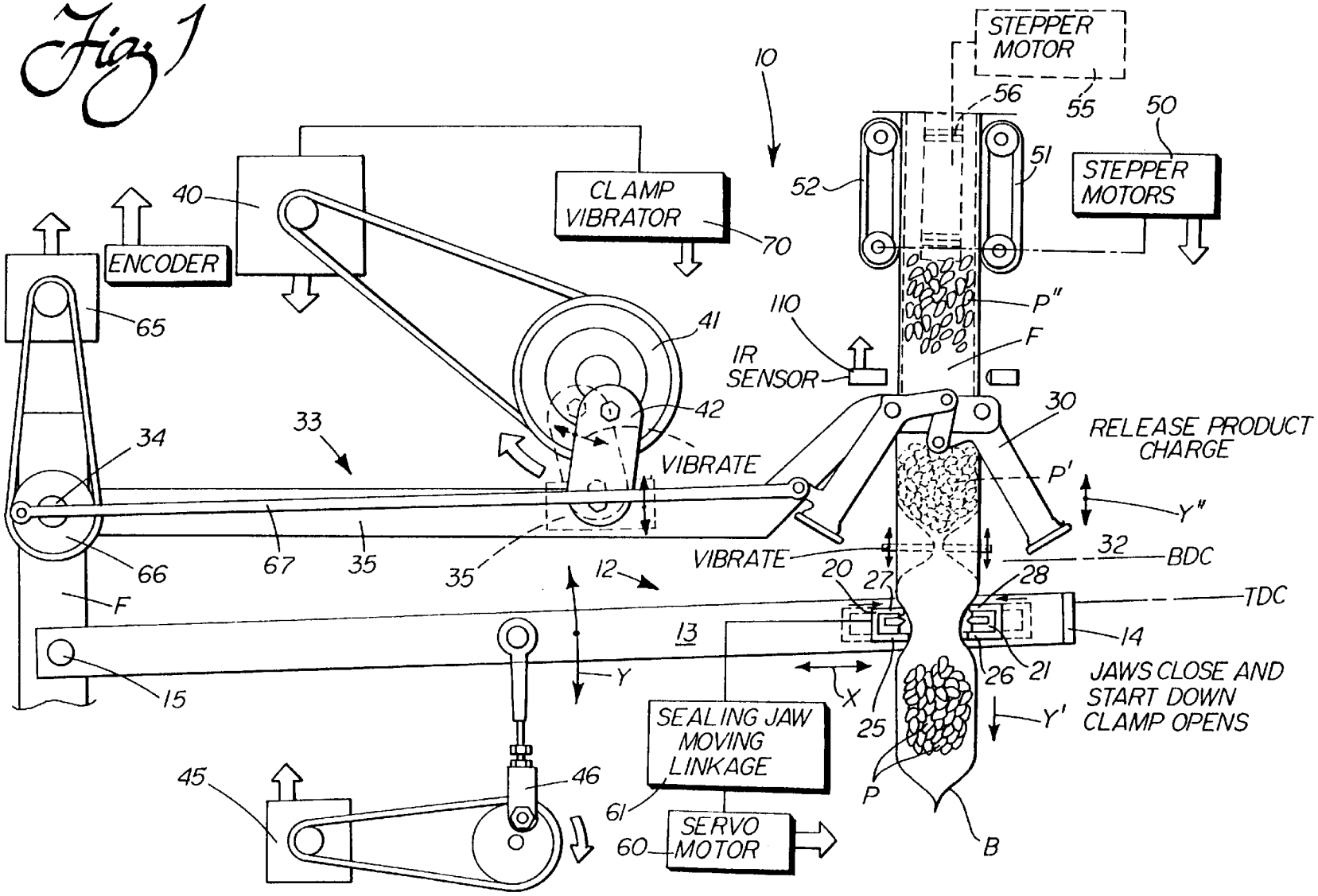
FIG. 1 is an overall schematic view of the lower portion of a form, fill and seal packaging system and illustrating several key components of the method/apparatus of the present invention.
Figure 1A:
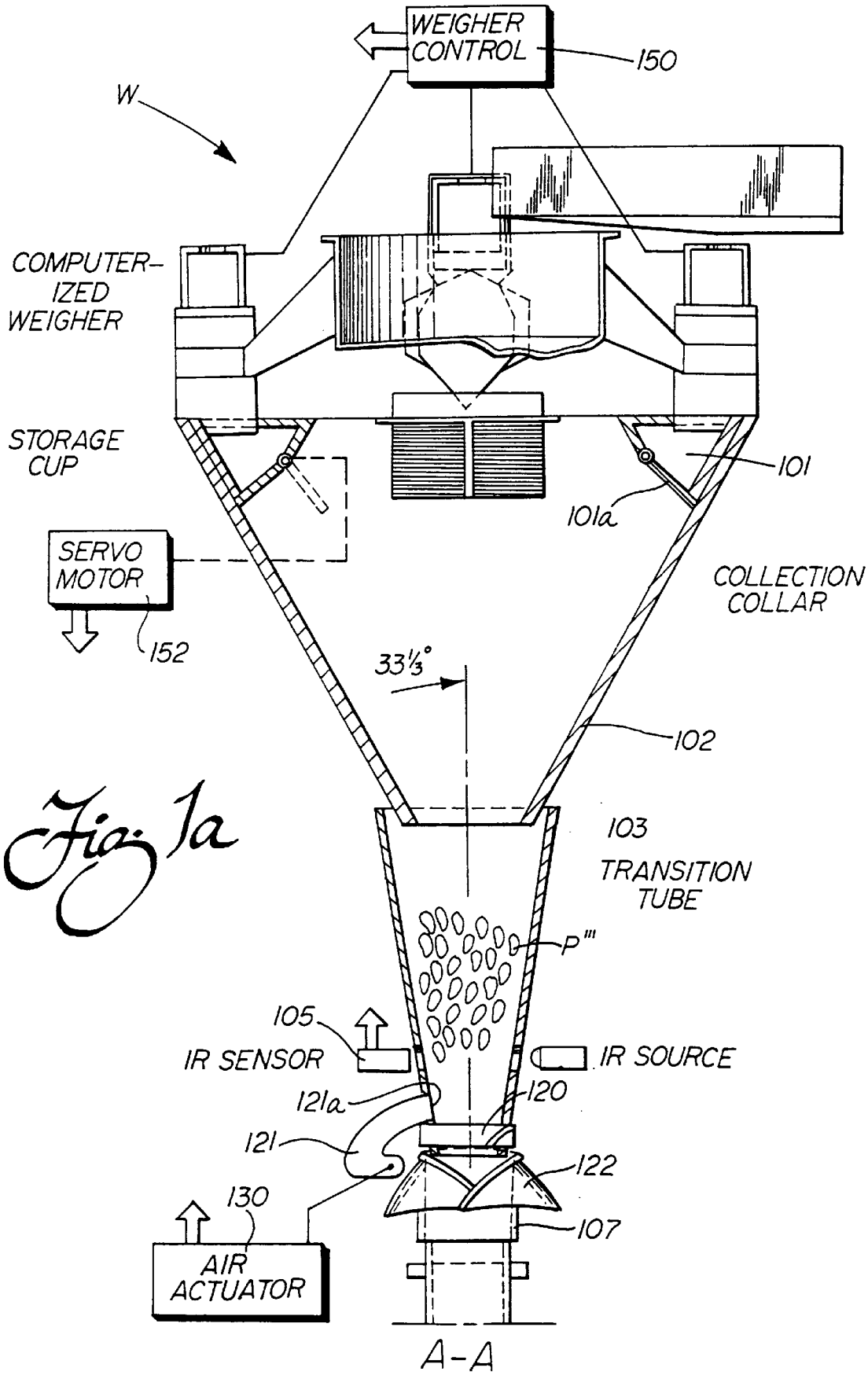
FIG. 1A is a schematic illustration of the upper portion of the overall product feeding and packaging system that is coupled along the line A—A with FIG. 1.

Reference is now made to FIGS. 1 and 1A showing the improved product feeding system and related packaging system comprising a computerized weigher W that includes an array of storage cups 101, which are provided inside a collection collar 102; the slope of the back wall of each cup 101 matching the slope of the annular wall of the collar 102. In effect, the cup/collar 101, 102 forms the first component of the transitional product flow path. In the preferred embodiment, the collar takes the form of an inverted, hollow truncated cone that receives the plurality (usually three) of fractional product charge portions when the pivotal gates 101*a* open in response to the dump signal from the CPU 76.

The collection collar 101, and thus the wall of the cup 101, has an approximately 30°–35°, and preferably a 33⅓° slope, relative to the vertical axis to allow the product portions to rapidly slide and come together at the bottom opening in the most efficient manner. It has been found that the chips, or other snack food, initially nest together and begin to form a compact charge in the most efficient manner at this angle. As the product charge portions are merging, a vortex flow is generated. The partially merged charge portions are then released from the bottom opening of the collection collar 102, and enter an extended transition tube 103 that has an approximate 12½° annular wall slope along the tapered sides. At this slope angle and with the extended length of the tube, the product charge portions continue to merge and nest. This specific taper design assures that flow disrupting collisions of the product pieces are minimized.

These factors result in an efficient combining action of the fractional charge portions that are being delivered from the computerized combinational weigher. The total product charge compaction in this manner provides for the desired rapid product transfer between the weigher and the package forming station or bagmaker.

After being thus merged and compacted, each sequential product charge, in turn and repeating in multiple cycles, may be identified as product charge P''' (see FIG. 1A). The transition tube 103 is extended in length sufficiently so as to assure further full nesting and compaction of each product charge P''', as it now enters a substantially free fall, in flight state substantially at maximum velocity.

Figure 4:
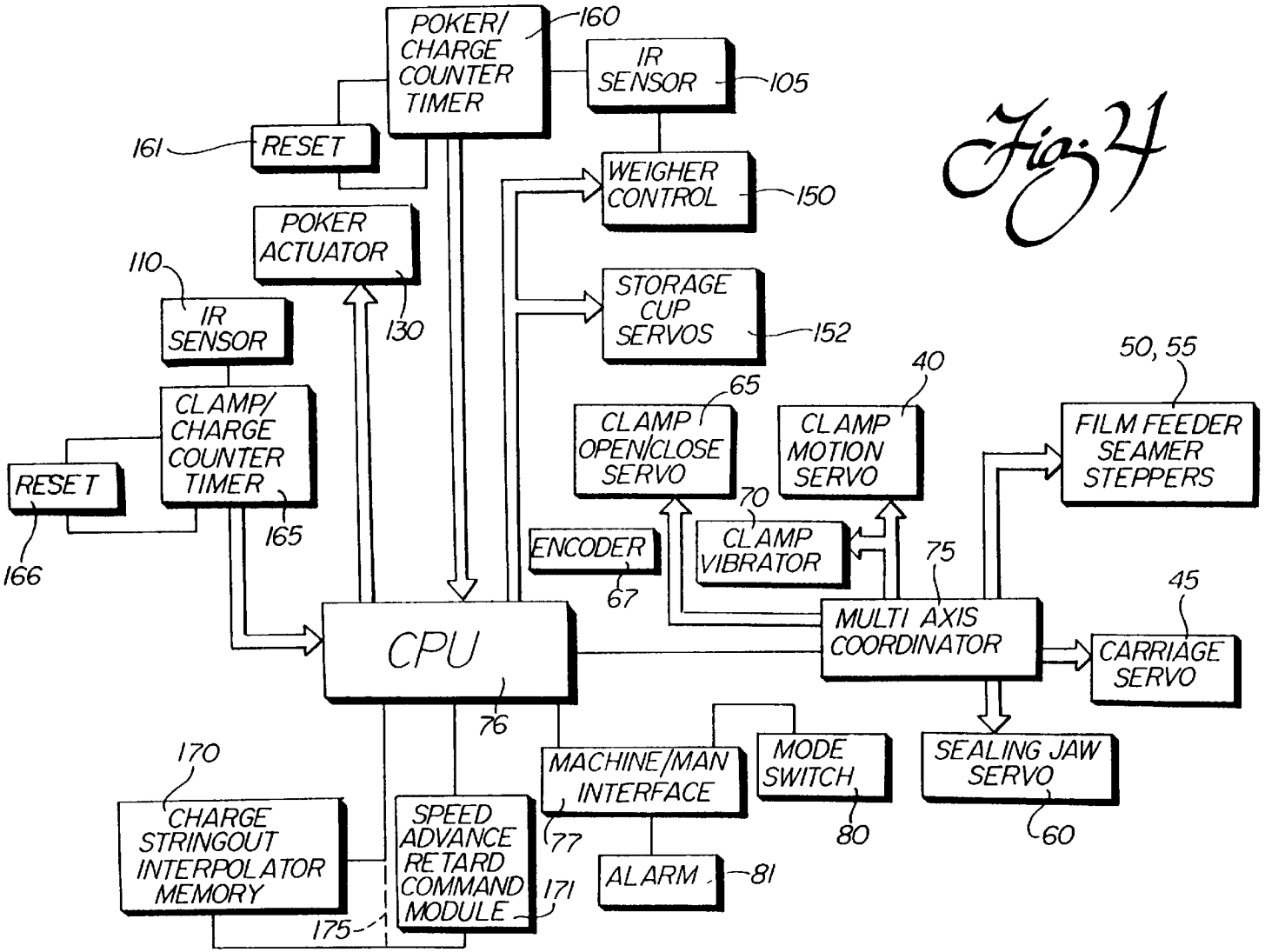
FIG. 4 is a schematic view illustrating the computerized control of advanced preferred embodiments of the present invention.

With reference to merged FIGS. 1, 1A (connected at merge line A—A) and FIG. 4, one or more sensors, such as an infrared sensor 105, is positioned along the feed path to sense the presence of each charge. As shown, this is just above the connector or collar 120 that attaches the transition tube 103 to product filling tube 107. As will be seen in more detail below, in the preferred embodiment, the sensor 105 being just upstream of the poker 121 is used to trigger its operation to be exactly at the right time as the charge P''' passes. A second sensor 110 is just upstream of the clamp 30, and times its closing to capture the charge just as it arrives, and this in flight charge is identified as charge P', in a similar manner. In between also in flight is another charge P''.

The sensors 105, 110 not only sense the first product piece in the product charges P'''–$P^n$ at a first time point, but also the last piece of each product charge is also sensed at a second time point. Through a timing sequence, the lag time and/or length of the gap to the next in-line charge is noted. As illustrated, the several charges are in flight from the weigher W to the bagmaker at any one time. If the gap between charges, that is from the second time point to the first time point of the next in line charge, matches the empirically determined ideal gap, or calculated time target/standard, then no speed change is made. However, if the gap widens, the speed of the packaging system can be ramped up on one of the following cycles; conversely, if the gap narrows, the speed can be reduced. In other words, at least the steps providing or weighing a charge, introducing the charge by opening the gates 101*a* and/or feeding the charge (see product charge P''') are adjusted in accordance with any time deviation found so that at least one of the next in line charges can approach the time target. In an ideal scenario, the very next in line charge is corrected.

It is important that not only is each product charge P'''–$P^n$ located or tracked along the product feed path for the gap between charges, but it is also in effect being sampled for lag, that is as to its stringout or vertical charge length. Adjustment can be made in accordance with the invention based on either or both, charge gap and charge lag, in response to sensing of the first and second time points. As previously mentioned, the two conditions are related since any charge lag necessarily increases the charge gap.

As will be seen more in detail below, the CPU/486 microprocessor processes the signals to adjust and thus adapt the timing of the entire packaging system/machine operating components. The operation of the combination weigher, the film feed/pull belts 51, 52, 56, the product settling clamp 30, and the stripper plates 25, 26 and the sealing jaws 20, 21 on the carriage 14 are all timed and coordinated through the encoder 67 on the clamp servo motor 65 and the multi-axis coordinator 75, which in the preferred embodiment thus becomes a 4-axis coordinator. All of these components are operated in response to the critical parameters of the product charge, including both the position or gap along the flow path and the stringout or lag.

Furthermore, for the first time truly efficient product flow enhancer means (such as a poker/air blast) prevents bridging of the product charges and prevents any tendency for product stringout and widening of the gap between them, during transfer from the tube 103, past the connector 120 and entering the fill tube 107. By thus preventing the slowing of the charges, in effect there is an overall increase in speed to the system. To put it another way, the enhancer means provides for increasing the velocity of each charge, as it passes this critical juncture in the system and reduces the gap/lag.

Positioning the sensors 105, 110 at known locations above the poker 121/clamp 30 assures proper timing. The poker 121 is moved by the air actuator 130 in response to the CPU 76, and a similar air source 131 (see FIG. 3) generates the air blast in timed relation. As indicated above, the poker 121 prevents any bridging of product at this critical location and the air blast from passage 120*a* can also help accelerate the trailing portion of the product charge as it passes this juncture and enters the fill tube 107 and the surrounding packaging film tube F. The air blast from passage 120*a* also has a primary function to assure that the packaging film tube F is fully opened as each charge sequentially passes through it, to further help assure proper product settling and compaction and bag filling.

Both of these product flow enhancements, as well as the clamp 30 are assured of operating in a synchronized fashion in response to the CPU 76. This substantially eliminates the undue wait time that is presently necessary with prior systems, as will be seen more in detail below.

As shown, the sensor 110 is positioned low in the transitional product feed path adjacent the product settling clamp 30. As the charge P" enters this lower area, the position along the feed path, but more importantly the charge length or stringout is again gauged as the infrared beam crossing the film tube F is broken. The first piece of the charge and the last piece of the charge are detected. The sensor 110 is positioned at the particular location above the point where the clamping jaws 32 come together so that as the charge P" transitions this area, it assumes the position of the next lower product charge P' in the most efficient manner. In other words, under computer control it arrives just as the jaws 32 close against the bag, as illustrated in the dashed line outline, no sooner or no later.

To provide the IR beam for the sensors 105, 110, there is provided corresponding IR beam sources 105*a* and 110*a* (see FIG. 1). To eliminate background noise, such as may be generated by the packaging film F, through which the beam to the sensor 110 must pass, suitable filters are used. In this manner, only the desired spectrum of energy is sensed providing high reliability. Furthermore, in accordance with the broadest aspects of the invention, other forms of energy sources/sensors, such as visible light bulbs/photocells, laser or radar beam sources/detectors, or the like, can be used.

Figures 2, 2A, 2B, 3:
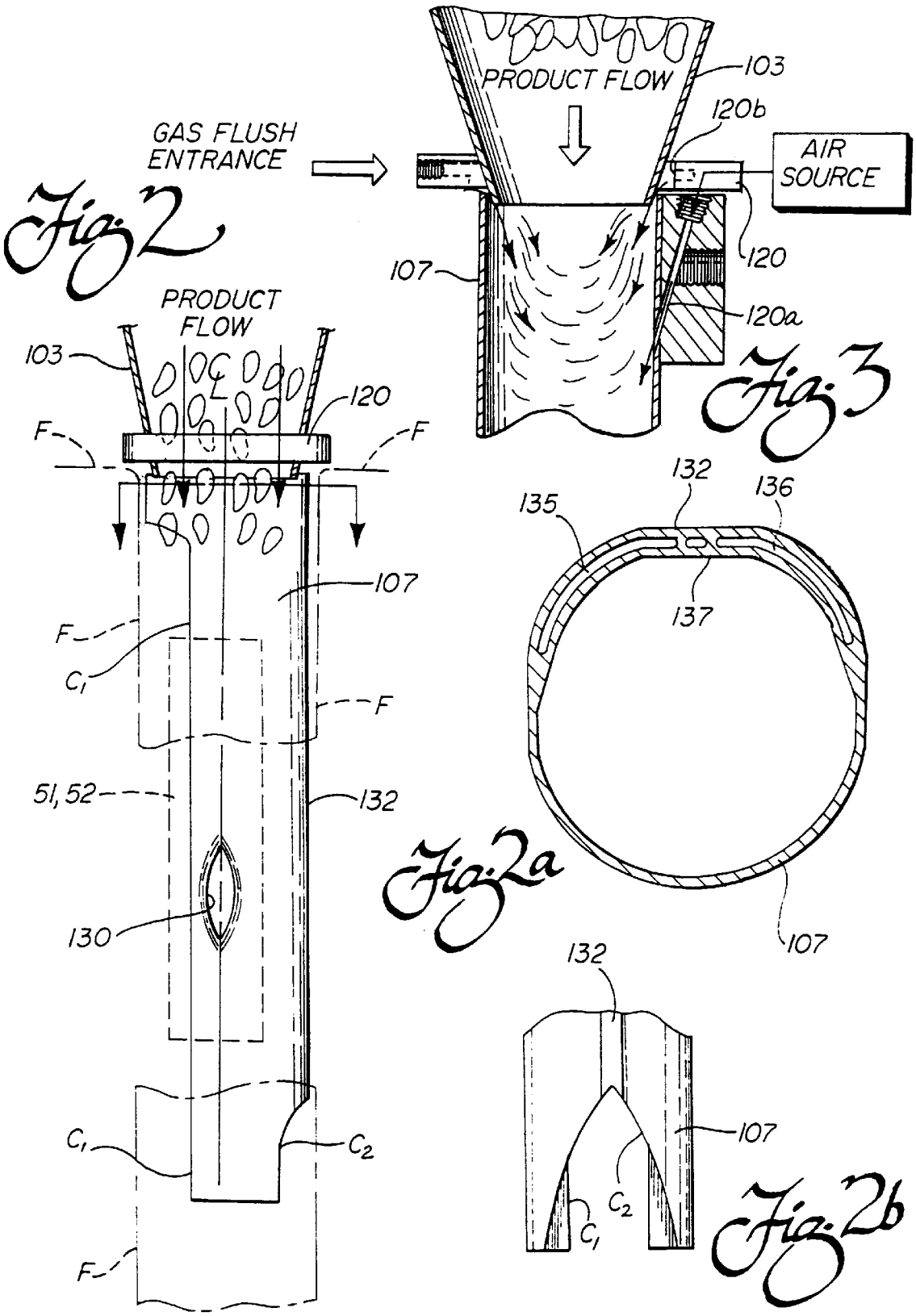
FIG. 2 is a side view with portions partially in phantom illustrating additional aspects of the present invention.
FIGS. 2A and 2B are a cross section and front view respectively showing additional details of the fill tube of the packaging system.
FIG. 3 is a cross sectional view illustrating the introduction of an air blast to compact the product charge and illustrating the merging of the transition tube and fill tube for enhancing product flow.

Inside the connector 120, and in addition to the air blast passage 120*a*, just above the entry orifice of the filling tube 107, there is preferably formed an annular passageway 120*b* to provide injection of a ring-like stream of an inert gas, such as nitrogen, as denoted by the flow arrows (see FIG. 3).

In operation, since the angle of the storage cups 101 for each of the weighing hoppers is at the optimum angle and mated with the collection collar 102, the charge portions slide quickly down into the transition tube 103 where the pieces are being nested together to form the compact product charge P'". Each charge in turn is immediately sensed for tracking and gauging as to length/stringout or gap/lag. The product charge quickly moves past the connector 120 and into the fill tube 107 and the packaging film tube F with the poker 121 and air blast from the passage 120*a* being actuated just at the right moment to prevent bridging and to blouse out or open the film tube F to assure free passage of each charge P", P' and P, all the way into the bag B (see FIG. 1).

As the product charge moves quickly to the position of product charge P", past the sensor 110 and finally into the position of the product charge P', the clamping jaws 32 of the clamp 30 capture it. The clamp 30 next opens in timed sequence to drop the charge P' into the bag B as the fully nested and settled product charge P. As described, this product charge flow thus occurs in the overall shortest, transition time along the entire flow path.

As can be realized, each of the transition points along the product feed path are fully matched, and the extended length transition tube 103 is effective to provide the optimum product compaction and nesting at the earliest possible stage along the path. The collection collar 102, the transition tube 103 and the filling tube 107 are preferably fabricated of approximately 16 gauge stainless steel sheet (0.0625 thickness) with the internal surfaces being mirror finished. All welded joints of the fabricated stainless steel sheet metal have the grain running vertically in the direction of the flow of the product changes. However, in order to provide an extended path for a "metal-free zone" where a plurality of in-line metal detectors can be placed, at least the transition tube 103 may be fabricated of approximately 16 gauge plastic, such as available high density polytetraflouroethylene plastic, also known by the trademark Teflon.

In any case, a smooth transfer and further flow enhancer is made between the collection collar 102 and the tubes 103, 107 by providing minimal stepping between the respective outlet and entry openings. The mating or merging relationship is held to an annular spacing of no more than approximately one sheet metal thickness (0.0625 inch).

The optimum opening of the top of the transition tube 103 is approximately 8 inches in diameter; whereas, the mating bottom opening of the collection collar 102 is at least approximately 7½ inches in diameter. This minimizes the tendency for turbulent air flow to be generated in these areas. By thus ensuring laminar air flow and minimal boundary layer disturbance around the product charges P'", P" during movement along the transitional flow path, time can be saved adding to the overall ability to speed up the packaging process.

The addition of the transition tube 103 with a steep slope angle, as well as providing a relatively steep slope angle of the collar 102, adds approximately 11 inches in length to the flow path. The overall velocity gain and increased nesting/compaction surprisingly more than offsets the additional travel distance needed, and indeed the overall transition time, or product fall time (or effective distance) is greatly reduced from the prior art arrangements. One important way this is provided is by having the multiple charges P'", P", P', P" to be in flight from the weigher at the same time. With multiple charges in flight all the way between the scale discharge and the bag sealing, this effectively minimizes each overall packaging cycle, that is, from the initiation of the transitional product flow to the closing of the bag B.

The desired result of the improved components forming the flow path, and the basic component operation as described, is thus effective to provide increased nesting and compaction of the charge of the product, to thereby avoid the introduction of product stringout, and overall quicker passage of each charge through the transitional product flow path. At the same time, the components and the timing of operation, are designed to reduce breakage of fragile products, such as potato chips. Coupled with the advanced integrated computer control, as set forth and to be described in greater detail below, greatly increased packaging efficiency is obtained. The last remaining bottle neck requiring slowing of the packaging machine to meet the worst case scenario is eliminated.

The preferred embodiment of the present invention also envisions an improved physical design for the poker 121 which adds to the efficiency of its flow enhancing function. The operative face 121*a* follows immediately behind the product charge P'" in timed sequence. Any inadvertent bridging of a product charge is loosened so it then freely enters the filling tube 107 and then into the film tube F at the former 122 without loss of significant time.

As illustrated in FIG. 1, the poker 121 is curved so as to be able to be rapidly projected into the product flow path at the split instant that the product charge P''' passes the connector 120. The operative face 121*a* of the poker substantially mates with the curved inside surface of the tube 103 in the retracted position (see FIG. 1). Because of this feature, the product charge flow is not hindered by either contact or air turbulence in any appreciable amount. Also, this feature allows the poker 121 to have the shortest possible operating stroke, which contributes significantly to the rapid actuation, entry and exit from the filling tube 107. The air actuator 130 controlled from the CPU 76 performs the high speed movement to further assure maximum efficiency of this function.

By employing the high speed poker, any bridging of the product charge P''' as it enters the filling tube 107 is promptly loosened, but breakage of product is minimized. The air actuator 130 is operative to sustain the quick response needed to maintain the synchronization of the movement of the charge along the transition tube 103, and then into the filling tube 107. This is required to maintain the desired increased speed and production rates. By matching the face 121*a* of the poker to the slope of the side of the tube 103 so as to avoid contact by the charges as they pass, this leaves the full cross section clearance of the flow path available for easy passage. While interference in the feeding is thus minimized, the poker 121 by positioning of its face 121*a* substantially flush with the wall of the tube 103, immediate movement into the feed path and contact with any bridging or lagging product pieces can be attained. The poker is thus operative to clear any bridged or lagging product in the quickest possible manner.

The fill tube 107 that extends down into packaging film tube F at the former 122 all the way to the clamp 30 is also designed for maximum feeding enhancement and efficiency. As illustrated in the side view of FIG. 2, the filling tube includes a cut-out section $C_1$ in the back in order to alleviate drag on the packaging film tube F as the film is pulled downwardly by the film pull belts 51, 52. This feature also allows for an increase in the cross sectional volume of the passage in this area, and lessens the chance of interference in the movement of the passing product charge P''.

As illustrated in FIG. 2A, and in FIG. 2 by dashed line outline, the film pull belts 51, 52 engage side flats to pull the film. On each flat of the filling tube 107 is an oval shaped and tapered crumb entry orifice 130 of approximately ¾ inch width and positioned at approximately 20° from the cut-out section $C_1$ of the tube. As illustrated, the entry orifice 130 is centered within the footprint of the belts 51, 52. This allows product crumb migration built up between the film and the tube to reenter the product feed path during normal operation. On the front of the tube 107 is a flat plate or area 132 for engagement by the belt 56 to form the back seam seal (see FIGS. 1 and 2A).

The packaging film tube F is shown in dashed line cut away form along the upper and lower portions of the filling tube 107 in FIG. 2. As will be realized, the back cut-out section $C_1$, the orifices 130 and the belt engaging flats help to reduce drag as the film wraps around the tube and is pulled for forming.

As illustrated in FIG. 2A, the filling tube 107 is preferably extruded, and is formed of aluminum. The flat areas on the side for engagement by the belts 51, 52 and a flat plate 132 along the front for engagement by the back seam seal belt 56 are all advantageously formed during the extruding process. The extrusion is also formed with elongated channels 135, 136 extending along the front and sides of the tube 107, and an additional channel 137 is formed in the middle front. These channels 135–137 serve as passages for wires for connection of product sensors (not shown) or other components that may be desired. Also, one of these channels, such as channel 136, can be used for transfer of a high volume gases at relatively low pressure, such as for added purging of the packages being formed. In this instance, the flushing gas, such as nitrogen, can be introduced at the bottom of the fill tube just above the point of engagement by the clamping jaws 32 (see FIG. 1). This arrangement does minimize the disruption/displacement of product in the bag thereby aiding product settling. Additionally, by having the gas passages within the walls of the tube 107, the available ID of the filling tube is maximized to aid in product flow. If desired, an annular gas passage cavity 120*b* can be provided in the connector 120, for introducing nitrogen gas from above. The gas is injected to the bottom of the fill tube 107, and is thus effective to provide additional assurance of displacement of the ambient air trapped in the bag B at the end of the packaging film F. As designed, this purging system operates to hold displaced air turbulence to a minimum as it moves back up along the feed path.

As will be realized, the entire structure of the transitional flow path, including the collection collar 102, the transition tube 103 and the filling tube 107, produce an uninterrupted full volume flow path to provide excellent gravity feed of the product. This allows the charge to nest together and remain as compact as possible thus reducing the stringout of the product as it is readied for introducing into the bag B being formed (see FIG. 1). The operation of the poker 121, the air blast passage 120*a* and the inert gas passages 120*b*, 136, and other flow enhancers, thus all also work together, and in concert with all of the other components, to provide product flow assist carrying the product charges P''', P'' and P' to entry into the bag B in the most favorable manner possible.

As shown in FIG. 2B, the bottom of the fill tube 107 has a tapered, V-shaped cut-out in the front adjacent the bottom. This cut-out provides additional clearance of the film tube F and the bag B during clamping by the clamping jaws 32, and upon engagement by the stripper plates 25, 26 and the sealing jaws 20, 21. In effect, the guiding function of the product charges inside of the tube 107 can thus be increased and the product flow enhanced beyond what has been attained in the past. Also, due to the V-shaped cut-out $C_2$ coupled with the cut-out $C_1$ along the back of the filling tube, it will be realized that the clamping jaws 32, stripper plates 25, 26 and sealing jaws 25, 26 are able to close against the bottom of the film F immediately adjacent the bottom of the filling tube 107 without undue stretching of the film.

With reference now to FIG. 4, and as briefly mentioned above, the central processing unit (CPU) 76 operatively includes a multi-axis coordinator 75, as fully set forth in the previous patent application, Ser. No. 08/350,877. As pointed out in that application, the coordinator 75 is fully operative on a real time basis to coordinate the various operating components that cooperate at the package forming station to intercept each product charge, fully settle and strip the product, and form the transverse seal of the bag B. As is thus apparent, all of the components operate in synchronization so as to provide a packaging operation that is capable of packaging in the range of 140–200 bags per minute, of course depending on the size of the bag being formed. A machine/man interface 77 is provided to allow each operator to introduce the variable settings that are required with each operation. The interface 77 may include a mode switch 80 that allows switching between manual, semi-automatic and automatic operation, along with an alarm 81, designed to alert the operator in the event that unacceptable operation is occurring, such as an over-speed condition.

In the operation of the electronic circuit of FIG. 4, it is an important factor of the present invention that three additional modes of operation can be utilized through the mode switch 80. These modes focus on the transitional product flow from the weighing station to the package forming station as described above.

In any of the three modes, the operator is able to reduce the number of variable settings that must be inputted into the packaging system prior to operation on a particular product and bag size. In particular, the operator only needs to input up to six so-called class 1 variables; namely packaging machine target speed, the bag length, the packaging film girth and former size, any blouse factor desired, the strip length desired and ambient temperature. With these six variable settings entered, the CPU 76 through a multi-dimensional matrix and interpolator is operative to control the basic operating parameters of the system.

In the past, the selection of a speed had to be greatly reduced since the operator had no way of interpreting the action of the product charge moving along the transitional product flow path. Now, in accordance with the present invention, through the first mode of operation, known as the predictive time adaptive mode, by sensing of the product in the flow path to track and calculate its position, as well as determine its stringout by sampling, the operator can manually set the critical operating parameters, and thereby increase the speed of the system to very close to the optimum. All of the critical timing parameters governing the packaging machine, including all of the components along the product introducing and feeding path, that is from the weighing machine to the sealing jaws, including all operating components in between, are now initially set.

In this first of the three modes, an alarm 81 is provided to indicate if there is an over-speed condition of the inputted target speed. This occurs when the gap between each of the in-flight charges $P'''$–$P^{n}$ is being sensed by the sensor 105 and the gap is being determined to be too narrow or short in order for the packaging process to proceed properly, as will be explained in more detail in relation to FIG 5. Conversely, if the condition of the product charges $P'''$–$P^{n}$ is just below the speed of the alarm condition, then it is within acceptable limits. The speed that is set by the operator is appropriate, optimum performance is now present and no alarm is visible and/or sounds. In other words, when the target speed is too high, the operator is alerted to manually lower it until the proper threshold is reached, and the alarm condition is eliminated. Because the alarm 81 predicts an over-speed condition and the operator is required to intervene, this mode of operation is referred to as the predictive time adaptive mode.

As will be more fully understood below, the predictive time adaptive operation can be carried out independently with the use of sensor 105 as above described, or in concert with the IR sensor 110 adjacent the product clamp 30. The timed location and the product stringout of the product charge P" is sensed by the sensor 110 providing a further basis for prediction of over-speed. By providing the alarm 81, the operator is alerted to ramp the speed back to a suitable slower level. In any case, the slower level is predicted to be at the threshold value that allows maximum speed of the system for the particular product charge being packaged at that particular time under those given conditions.

The empirical data for setting the alarm threshold in this mode may be calculated by sensing the product charge in-flight times (tracking), and/or the calculated standard deviations of the length of charges (stringout) at the two locations. This data is obtained "off-line", by running representative sample(s) through the packaging system prior to start of production. While the data is obtained "off line" a continuous readout of predicted maximum settings are displayed. This allows the operating personnel to immediately see the results of mechanical and/or product related changes/adjustments to the product flow path in terms of predicted maximum speed. It has been found that the data calculated and displayed has a reasonably broad application over multiple product runs, and of course is dependent on product type, density, weight, ambient conditions, product build-up and weigher delivery efficiency.

When using the predictive time adaptive mode, it is of course necessary for the operator to continue to update the speed control through operation of the machine/man interface 77, the CPU and the multi-axis coordinator 75. In this mode, the intervention by the operator is of course required to continue close to optimum performance. After each product change, as well as for any significant change in the ambient condition, the density of the product being packaged, or the build-up of product, especially toward the end of any operating shift, an adjustment of the speed through the interface is likely required. For a gradual change in such parameters that slow the product charge during its passage through the packaging system, the over speed alarm 81 is simply displayed by visible indication or sound alerting the operator to change the setting. Of course, the change in the parameters can act either way so that periodic checking and intervention by the operator is required. At any given time, the speed of operation might be able to be increased to increase productivity, or it might have to be slowed to prevent the charges from overrunning the bagmaker.

In the second mode of operation, known as the fully time adaptive mode, any such trend of the change in product, or from other parameters, can be automatically sensed. In this instance, for the sensor 105 adjacent the poker 121, a permanent charge counter and a charge gap timer 160 is interposed in the circuit, preferably as a part of the CPU 76. As will be explained more in detail below, the counter/timer 160 keeps track of the condition of the product charge and adjustments to counter a trend from optimum performance can be automatically provided. The CPU 76 provides feedback signals to the multi-axis coordinator 75 to adjust each of the operating components, as described above. Furthermore, the dump request signal to the weigher control 150 and the storage cup servos 152 is automatically adjusted to remain synchronized.

The product charge stringout interpolator/memory 170, also preferably a part of the CPU 76, provides an averaging routine and memory to detect the trend of change in the system, rather than simply relying on an instantaneous variation. By averaging, hunting or jittering of the operating components of the packaging system is avoided. As the trend is interpreted by the interpolator/memory 170, a speed advance/retard command module 171 (also a part of the CPU 76) receives a signal to routinely advance or retard the speed of the components (as necessary) through the multi-axis coordinator 75. Where the counter/timer 160 detects the product charge as remaining substantially well defined and compact, no change, or a minimal change is provided. Of course, this concept of averaging is an integral part of the predictive time adaptive operation as the data is obtained "off-line", as indicated above. In any case, the comparison of the product charge to the time index results in adjustment of at least one of the next in line or following charges to approach the time target. The CPU 76 can either advance or retard the packaging system by providing the advance/retard signal to the coordinator 75. Each time the components are ramped up or down to advance or retard the speed, the weigher control and storage cup servos 150, 152 are changed in a coordinated fashion.

In a fashion similar to the predictive mode, the sensor 110 can be utilized separately or in concert to track the position and sample the stringout of the product charges P'''–P$^n$ in order to provide even more accurate results. A charge counter/timer 165 is provided to process the signal for the sampling function of the charges. By updating the interpolator/memory 170 with two inputs, that is from the sensor 105 and the sensor 110 acting in concert, a highly accurate indication of how the charges are traveling through the flow path can be obtained. This in turn allows adjustment of the operating speed of the packaging system to be as near to the threshold or target speed defining maximum operating efficiency as possible. With the sensors 105, 110 and the respective charge counter/timers 160, 165 both sending tracking/sampling signals to the interpolator/memory 170, and averaging these tracking/sampling signals is taking place, practice has shown that a highly reliable and efficient speed, without risking an overspeed condition, can be maintained.

The third operating mode of the control circuit of FIG. 4 of the present invention relates to real time adaptive operation. In this instance, again the tracking/sampling occurs at the position of sensors 105 and/or 110, and the signals are sent directly to the CPU 76 for processing. Any deviation from the optimum position or stringout of the charge is noted. In this case, since the charge stringout interpolator/memory 170 is bypassed, as illustrated by the dashed line jumper 175, the command module 171 provides the appropriate speed correction signal to the CPU 76 capable of making an instantaneous or real time correction of the speed of the packaging system. In this instance where relatively large changes are possible, control is preferably limited to only retarding the speed of the system to prevent over correction or hunting.

In other words, in the instance where a free flowing solid product charge P''', such as potato chips, is sensed as being non-standard, such as very long or strungout and thus reducing the required gap beyond what can be accommodated at normal operating speeds, then the command module 171 signals a slow down for that particular cycle. The feeder/back seam sealer stepper motors 50, 55 for the packaging film F, along with all the other components, are appropriately retarded in time so that the particular designated bag B receives the non-standard charge. Once the non-standard product charge is cleared and thus is appropriately accommodated by the system, the CPU 76 returns to normal operation during which only minor, averaged corrections, either faster or slower through the command module 171, are made.

Figure 5:
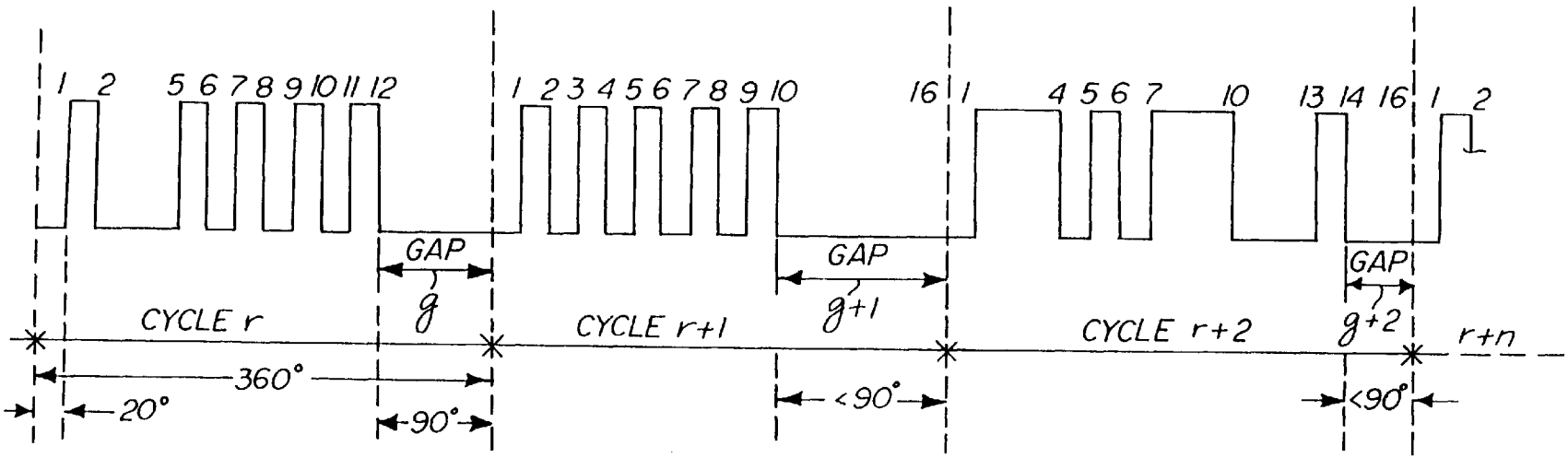
FIG. 5 is an illustration of the operation of a charge timer showing the output signal pattern of a corresponding sensor for three cycles of the packaging system.

The manner in which one of the charge counters/timers 160, 165 operate can be seen by reference to a typical output signal pattern sensed by the corresponding sensors 105, 110 for three typical, in-flight product charges, (see FIG. 5). A full rotational cycle of the packaging system defining a calculated time standard or defined time target illustrated by cycle r, with typical following cycles r+1 and r+2. A gap of approximately 20° is built into the front of each cycle. In other words, for any product charge, P'''–P$^n$ no product piece is expected to be in the path of the beam to be detected by either the sensor 105 or 110 at this time. Further, a trailing gap defined by approximately 90° of machine operating rotation is left open at the end of each cycle. At the end of each rotational cycle r, r+1, r+2 . . . r+n, the counters/timers 160, 165 are reset by the reset switches 161, 166, respectively, and the length of the gap g, g+1, g+2 . . . g+n is determined. A first time point is located when the leading portion of the product charge is sensed, as noted by the numeral 1 in cycle r, and a second time point is noted by the trailing portion, such as by numeral 12 in cycle r.

Since the product charge includes distinct pieces which fall through the transition tube 103 in a random pattern, each of the sensors 105, 110 sees either single pieces, or a plurality of pieces across the tubes 117 or F, respectively. The signals are converted to digital pulses, as denoted by the series of numerals in FIG. 5. Each rotational cycle may be divided into the same number of segments, such as 16.

Thus, during cycle r of FIG. 5, which can be considered as representing the perfect product charge tracked position and stringout, within 12 segments of the 16, all of the pieces clear the sensor 105, 110. This leaves the ideal 90° rotational part for the gap g where no product pieces are present. Thus, the poker 121 (and air blast) and the clamp 30 can easily operate in timed sequence within the defined time target to perform their function. After the counter completes the count (12 in cycle r), the timer having been reset each time, it records the final gap g time between the second time point and the first time point of the next in line charge in cycle r+1. This signal goes to the interpolator/memory 170, such as for averaging, or directly to the command module 171 for real time correction consideration. The gap g being ideal, no advance or retard of the system occurs.

In the cycle r+1, the product charge P'''–P$^n$ is more fully nested and compacted, so that the last piece at the second time point is denoted as digital pulse 10, leaving a gap g+1, which is over the desired gap g (greater than 90° rotation). Thus, a signal is generated to the CPU to ramp up the speed (either average or real time depending on the mode of operation). Thus, the packaging system efficiency can be increased.

Finally, in the cycle r+2, the gap g+2 is reduced to less than the desired approximately 90° rotation of the package forming apparatus; thus indicating through the appropriate charge counter/timer 160, 170 that the system must be slowed to allow the charges to be properly positioned along the flow path.

During the cycle r, r+1, r+2 . . . r+n, 16 events can take place regardless of the speed of the machine. The designated 90° gap g at the end of each timing sequence is defined as the optimum and occupies 4 events or the 90°. In the preferred embodiment, for a typical bag forming operation, the gap g can be approximately 50 milliseconds. For each event where there is an interruption of the energy beam, the gap timer 160, 165 is reset. By counting and resetting each time, the gap can be determined. Once the gap timer expires from the time the last product piece interrupts the beam until the cycle is over, that relative increase/decrease determines the correction to be averaged in or to be applied in real time.

By averaging the gaps, the 20° rotational space at the front of each cycle and the 90° rotational space at the end of each cycle can be reliably maintained. In this way, the first and last piece in each product charge is maintained within the window provided for the maximum efficiency operation of the packaging system. Hunting or jittering is avoided.

Also, by maintaining the gaps within the designated range through operation of the sensor 105, the system assures that the last product piece of the charge P'" is not late with respect to the movement of the poker 121. Similarly, the operation of the sensor 110 assures that a piece from a product charge P" does not lag behind, or in some cases escape ahead, so as to be caught by the closing of the clamp 30 and thus be susceptible to dropping into the upper seal area of the bag B below to cause a faulty seal.

In the event that a change in the packaging system occurs, such as to cause the product charges P'"–P$^n$ to slow, such as a change in the product content, the ambient humidity or temperature, or the build up of residual material along the path, the interpolator/memory 170 in effect notes this change and the command module 171 issues a signal to correct the speed through the CPU 76. As has been determined by experience due mostly to the build up of product along the transitional product flow path toward the end of an operating shift of the packaging system, the command module 171 in most instances is gradually retarding the speed from the optimum. It will be recognized that the packaging system has up to that point operated at the maximum acceptable speed so that the overall advantage with the use of the control system of the present invention is substantial.

Other adaptive control operations are contemplated using the broadest concepts of the present invention. For example, a plurality of sensors (not shown) can be incorporated into the computerized weigher to provide additional input for interpretation to anticipate what real time adjustments are necessary for the next product charge. Such considerations, as the specific position and the number of storage cups 101 to make up the next charge P$^n$, can help the system run even more efficiently.

In summary, a continuous vertical form, fill and seal packaging machine with improved transitional product flow along the flow path between the combination weigher and the package forming station is provided. The collection collar 102, the transition tube 103, the poker 121, and the connector 120, and all of the functions represented thereby, contribute to increased efficiency. In addition, the adaptive control system through the control circuit of FIG. 4 provides a way for either predicting the optimum speed where an operator controls the system, or providing a fully adaptive or real time control that operates in a fully automatic manner through feedback signals from sensors 105, 110.

What is claimed is:

1. A method for feeding sequential product charges in cycles within a defined time target for packaging comprising the steps of:

providing a substantially free flowing charge of product to be packaged;

introducing and at least initially feeding the product charge along undriven substantially vertical flow path;

sensing the presence of the charge at a first time point representing a selected location along said path;

comparing the sensed charge presence to the defined time target; and adjusting at least one operating step of the feeding method in accordance with any deviation found during the comparing step to cause the charges to approach the time target, whereby through adaptive control the speed and efficiency of the transitional product flow and the feeding method can be maximized.

2. The method of claim 1, wherein during the sensing step a second time point when the charge is sensed is determined, and during the adjusting step changing the introducing and feeding of at least one of the next in line charges so as to substantially match the time target.

3. The method of claim 2, wherein said first time point is denoted by sensing of the leading portion of the charge.

4. The method of claim 3, wherein during the sensing step the trailing portion of the charge is determined at the second time point, and adjusting one of the next in line charges in accordance with the time lag between the first and second time points to further substantially match the time target.

5. The method of claim 4, wherein the sensing step is performed at at least two locations along the flow path.

6. The method of claim 5, wherein the introducing and feeding step of the sequential product charges provides at least first and second product charges along said path at one time, and sensing the first and second time points for each charge, said comparing step includes finding the gap between said second time point and said first time point of the next in line charge.

7. The method of claim 6, wherein said adjusting step includes averaging the deviations found and advancing the introduction and feeding of the second product charge when the gap widens and retarding the same when the gap narrows.

8. The method of claim 1, wherein during the sensing step the leading and the trailing portion of the charge is determined at respective first and second time points for each charge, and adjusting the movement of at least one of the next in line charges in accordance with the time lag between the first and second time points to substantially match the time target.

9. The method of claim 1, wherein the step of adjusting the movement of the next in line charge includes/enhancing the product charge flow by engaging the trailing portion with a poker to loosen any bridging of the charge, accelerate the charge and reduce the lag.

10. The method of claim 9, wherein the step of adjusting the movement of at least one of the next in line charges includes enhancing the product charge flow by engaging the trailing portion with an air blast to compact the charge and reduce the lag and accelerating the charge to narrow the gap between the charges.

11. The method of claim 10, wherein providing a substantially free flowing charge of product includes defining the flow path by a relatively low friction, large cross section in line collection collar, transition tube and fill tube.

12. The method of claim 11, wherein providing a substantially free flowing charge of product further includes defining the collection collar by a sloping annular wall of between approximately 30°–35° with respect to a vertical axis, the transition tube with a sloping annular wall of approximately between 10°–15° and a fill tube with a substantially vertical annular wall.

13. The method of claim 12, wherein providing a substantially free flowing charge of product further includes forming said collar and tubes of sheet material of approximately 0.0625 inch and merging said collar/tubes with spacing of approximately one sheet thickness.

14. The method of claim 1, wherein the defined time target for feeding of the charges is set by repeating the operating steps until the adjusting step is satisfied.

15. The method of claim 1, wherein is provided the additional step of forming, filling and sealing sequential packages to form bags of packaging film containing said charges, and setting the speed of forming, filling and sealing to synchronize and provide optimum matching of the feeding of the product charges.

16. The method of claim 15, wherein is provided the additional step of synchronizing the forming, filling and sealing of the packages and the feeding of the product charges by computer.

17. The method of claim 16, wherein is provided the step of assisting in setting the time target by initially inputting to the computer at least (1) packaging target speed; (2) bag length; and (3) bag girth.

18. A method for feeding sequential product charges in cycles within a defined time target for packaging comprising the steps of:

providing a substantially free flowing charge of product to be packaged;

introducing and feeding the product charge along a defined flow path;

sensing the presence of the charge at a first time point representing a selected location along said path;

comparing the sensed charge presence to the defined time target;

adjusting at least one operating step of the feeding method in accordance with any deviation found during the comparing step to cause charges to approach the time target; and the adjusting step including enhancing the product charge flow by engaging the trailing portion to loosen any bridging of the charge, accelerate the charge and reduce the lag, whereby through adaptive control the speed and efficiency of the product flow and the feeding method can be maximized.

19. The method of claim 18, wherein at least some of the steps are performed manually so as to provide predictive time operation.

20. The method of claim 19, wherein the defined time target for feeding of the charges is set by repeating the operating steps until the adjusting step is satisfied.

21. The method of claim 1, wherein at least some of the steps are performed manually so as to provide predictive time operation.

22. A method for feeding sequential product charges in cycles within a defined time target for packaging comprising the steps of:

providing a substantially free flowing charge of product to be packaged;

introducing and feeding the product charge along a defined flow path;

sensing the presence of the charge at a first time point representing a selected location along said path;

comparing the sensed charge presence to the defined time target;

adjusting at least one operating step of the feeding method including engaging the trailing portion of the product charge flow with a poker to enhance the product charge flow in accordance with any deviation found during the comparing step to cause the charges to approach the time target, whereby through adaptive control the speed and efficiency of the transitional product flow and the feeding method can be maximized.

* * * * *